United States Patent [19]

Stratman

[11] 4,310,933

[45] Jan. 19, 1982

[54] FOOD WASTE DISPOSER MOUNTING ASSEMBLY

[75] Inventor: Jerome F. Stratman, Cypress, Calif.

[73] Assignee: Tappan Company, Mansfield, Ohio

[21] Appl. No.: 55,155

[22] Filed: Jul. 6, 1979

[51] Int. Cl.[3] ..... A47K 1/14; E03C 1/26

[52] U.S. Cl. ..... 4/286; 4/DIG. 4; 241/100.5; 241/46 A; 285/360

[58] Field of Search ..... 4/286, DIG. 4, 191; 285/360, 192; 241/100.5, 46 A, 46 B, 46.08, 32.5; 220/301

[56] References Cited

U.S. PATENT DOCUMENTS

| | | | |
|---|---|---|---|
| 2,220,729 | 11/1940 | Powers | 241/100.5 X |
| 2,322,058 | 6/1943 | Powers | 241/100.5 X |
| 2,421,014 | 5/1947 | Coss et al. | 241/100.5 X |
| 2,743,875 | 5/1956 | Brezosky | 241/100.5 |
| 2,846,154 | 8/1958 | Wieczorek | 241/100.5 |
| 2,879,949 | 3/1959 | Jordan | 241/100.5 |
| 2,939,639 | 6/1960 | Coss | 241/100.5 |
| 2,945,635 | 7/1960 | Jordan | 241/100.5 |
| 2,949,246 | 8/1960 | Hyde | 241/46 |
| 2,978,190 | 4/1961 | Brucken et al. | 241/46 |
| 3,009,657 | 11/1961 | Jenkins | 241/100.5 |
| 3,025,007 | 3/1962 | Wieczorek | 241/100.5 |
| 3,084,877 | 4/1963 | Bebinger | 241/46 |
| 3,203,714 | 8/1965 | Cronk, Jr. | 241/46 X |
| 3,464,638 | 9/1969 | Enright et al. | 241/100.5 |
| 3,768,742 | 10/1973 | Preher et al. | 241/100.5 |
| 3,801,998 | 4/1974 | Macias | 4/DIG. 4 |
| 3,982,703 | 9/1976 | Meyers | 241/100.5 |
| 4,135,258 | 1/1979 | Braga et al. | 4/DIG. 4 |

*Primary Examiner*—Henry K. Artis

*Attorney, Agent, or Firm*—Maky, Renner, Otto & Boiselle

[57] ABSTRACT

A disposer mount assembly includes a non-rotatable plastic sink flange having a tubular portion extending downwardly through and beneath the drain opening and terminating in a lip resiliently embraced by an elastomeric cushion mount, a mounting ring with inclined camming slots rotatably mounted on the tubular portion by the cushion mount, and a disposer hopper having an upper flange with lugs projecting radially outwardly therefrom into the camming slots. Selective rotation of the mounting ring cams the lugs upwardly along the inclined camming slots to a final locked position therein in which the correspondingly elevated hopper flange is connected to the mount ring and compresses the cushion mount, thereby to provide a tight resilient seal between the disposer and sink flange to absorb vibration and sound.

15 Claims, 4 Drawing Figures

FOOD WASTE DISPOSER MOUNTING ASSEMBLY

FIELD OF THE INVENTION

This invention relates generally to a waste food disposer mounting assembly.

BACKGROUND OF THE INVENTION

For years, food waste disposers have been suspended in various ways from tubular metal drain sleeve forms fastened in the drain opening of the sink. One common assembly for mounting a disposer on a sink includes a thin-walled stainless steel drain sleeve having an upper radially outwardly extending flange portion that contacts the sink surface adjacent the drain opening and a downwardly extending tubular portion. The lower end of the tubular portion protruding beneath the sink is provided with a radially outwardly opening groove receiving a snap ring to define a radially outwardly extending shoulder. Such shoulder carries a mounting ring having a plurality of tapped apertures. Bolts are screwed upwardly through the mounting ring apertures to contact an annular protection ring and press it upwardly against the bottom of the sink to draw the drain sleeve flange downwardly into fixed relation with the sink. These bolts may also couple the disposer to the drain sleeve. For this purpose, the upper end of the disposer hopper may have a radially outwardly extending flange with slots or openings therein for receipt of each bolt. The disposer flange is positioned proximate the drain sleeve so that each bolt extends through its respective slot or opening. Nuts are then secured to the lower projecting ends of the bolts and are tightened upwardly to secure the hopper flange against the mounting ring.

Other disposer mounting assemblies similar in arrangement to that described above have been used, and more recent assemblies have adopted quick connect and disconnect features to reduce transmitted vibrations. For examples of such assemblies, reference may be had to U.S. Pat. Nos. 3,768,742; 3,025,007; and 3,108,755.

The described disposer mount assemblies are believed to suffer from several structural and functional disadvantages. For example, the commonly used mounting bolts (customarily three in number) require tightening to secure the drain sleeve to the sink. Such bolt installation is awkward in the limited spatial confines beneath the sink and is also time consuming. In addition, the bolts and/or nuts may be unevenly tightened resulting in leaks at the drain opening, or in undesirable stress patterns being developed in the sink adjacent the drain opening which may lead to fracture or other damage to the sink. In addition, the snap rings commonly required in many prior art assemblies are difficult and time consuming to install, particularly by the lay person. A further disadvantage of many disposer mounting assemblies is that rotation of the disposer on its vertical axis is restricted after mounting. This makes the connection of the disposer to existing plumbing very difficult.

SUMMARY OF THE INVENTION

One of the objects of the present invention is to provide a disposer mounting assembly that permits easy and rapid disposer installation, while eliminating the need for special tools and/or plural bolt and nut fasteners. To this end, in the present invention, the sink flange including a shoulder and tubular portion is initially clamped to the sink by a threaded plastic ring being screwed upwardly along the external threads on the tubular portion until engaging the underside of the sink to draw the shoulder into tight engagement with the top of the sink adjacent the drain opening. The disposer hopper is then sealingly clamped to the sink flange by a mounting ring rotatably carried on the tubular portion of the sink flange by a resilient cushion mount stretch fit thereon. The mounting ring includes cam means receiving cam followers projecting from the hopper flange, with selective rotation of the mounting ring camming the cam followers upwardly correspondingly to elevate the hopper flange into a compressive, clamped seal with the cushion mount on the tubular portion of the sink flange. These assembly operations may be rapidly performed in limited space quarters with convenient coupling to household plumbing.

It is another object of the present invention to provide a disposer mounting assembly that is capable of absorbing disposer vibrations to provide quieter operation. The compressed rubber cushion mount between the hopper flange and sink flange of the present invention does absorb vibrations to reduce the sound level.

It is yet another object of the present invention to provide a less expensive disposer mount assembly. To this end, the sink flange and support ring may be made of plastic rather than steel, and the rubber cushion mount eliminates the need for more expensive nut and bolt fasteners with associated clamping hardware. If desired, the plastic sink shoulder on the sink flange may be covered by a thin stainless steel cap crimped or press fit thereon, thereby to reduce costs relative to stainless steel sink flanges while still giving the appearance of stainless steel.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but a few of the various ways in which the principle of the invention may be employed.

DESCRIPTION OF THE PREFERRED EMBODIMENT

Figure 1:
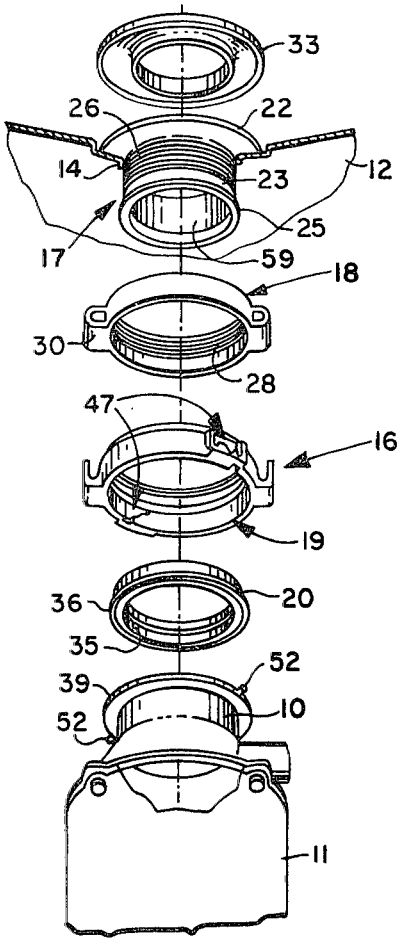
FIG. 1 is an exploded perspective view of a disposer mounting assembly according to the invention showing the parts thereof prior to assembly.
Figure 2:
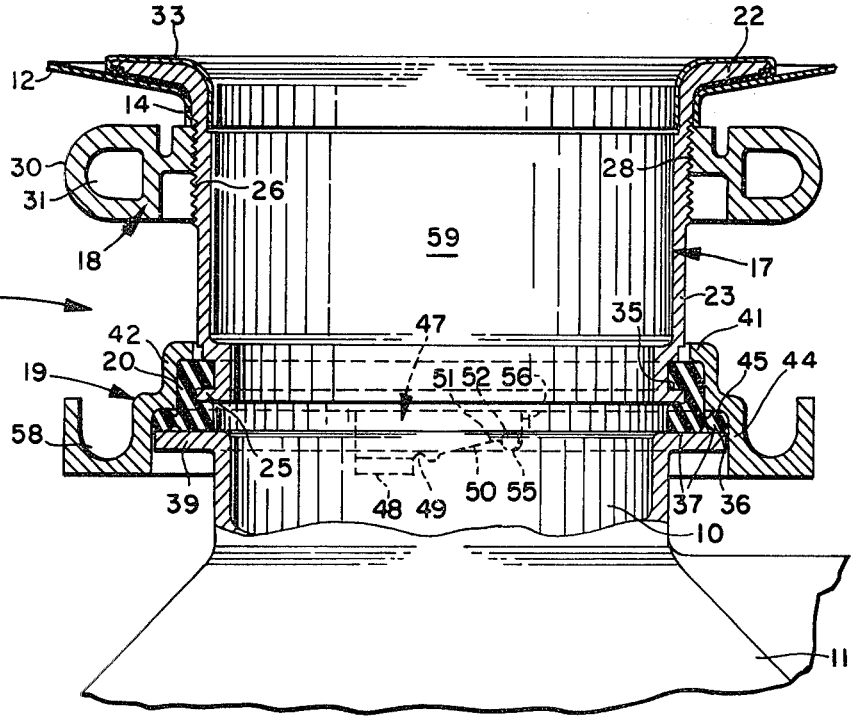
FIG. 2 is a transverse section of the mounting assembly of FIG. 1 as assembled.

With reference to FIGS. 1 and 2, a disposer hopper 10 of a food waste disposer 11 is suspended from and below the kitchen sink 12 at the drain opening 14 therein by the mounting assembly of the present invention designated generally by reference numeral 16. The mounting assembly 16 includes a sink flange 17, a support ring 18, a mounting ring 19 and a cushion mount 20, as described in more detail below in the assembly sequence.

The sink flange 17 has an upper radially outwardly extending shoulder 22 and a downwardly extending tubular portion 23. The underneath side of shoulder 22 is coated with a ring of putty and the tubular portion 23 is then lowered through and below the drain opening 14 until the shoulder 22 seats on the sink surface. The shoulder is then pressed against the sink uniformly to distribute the putty between the shoulder and sink to provide a seal therebetween and to assist in holding the sink flange 17 against rotation.

The downwardly extending tubular portion 23 has a radially outwardly extending mounting lip 25 at its lower end and an externally threaded portion 26 of slightly enlarged diameter at its upper end. The support ring 18 has a threaded surface 28 slightly larger in diameter than lip 25 to allow the support ring to be slid upwardly along the tubular portion 23 until the internal threads 28 thereof mate with the external threads 26 on the tubular portion 23. The support ring 18 may then be screwed upwardly along the threaded portion and tightened against the underside of sink 12 to draw the shoulder 22 tightly against sink 12, thereby clampingly to secure the sink flange in place. Preferably, the support ring 18 is provided with a pair of diametrically opposed radially outwardly extending ears 30 having holes 31 extending therethrough for receipt of a suitable tool, such as a screwdriver, to facilitate threaded tightening of the support ring 18.

Both the sink flange 17 and support ring 18 may be made of plastic material and are accordingly relatively inexpensive and easy to manufacture. For appearance purposes, however, a sink flange cap 33 of stainless steel may be crimped or press fit on the sink flange 18 to overlie the upper exposed surface of the shoulder 22 to give the look of a solid stainless steel sink flange.

With the sink flange thus positioned and clamped in place, the mounting ring 19 is slid upwardly over the tubular portion 23 of the sink flange 17 and is held in such position until the cushion mount 20 can be secured on mounting lip 25. To this end, the annular cushion mount 20 has a radially inwardly opening groove 35 adapted to embrace the mounting lip 25 in interlocking relationship. The cushion mount 20 is made of a suitable elastomeric material, such as butyl rubber having a shore hardness of about 50, and is sufficiently elastic to be diametrically stretched over the mounting lip 25 during the mounting thereof on the sink flange 17. The cushion mount groove is normally slightly smaller in diameter than the lip 25 so that the cushion mount fits snugly on the lip when unstretched. Further, the cushion mount 20 is formed with an integral annular sealing bead 36 projecting radially outwardly therefrom with the bottom sealing surface of the bead being in substantially the same horizontal plane as the bottom surface of the major portion of the cushion mount body. Together, the bottom surfaces of the cushion mount 20 and the sealing bead 36 define a mounting and sealing surface 37 for engagement by the flange 39 of hopper 10, which is held in place after assembly by mounting ring 19.

To this end, with the cushion mount 20 in place on lip 25, the mounting ring 19 is lowered along the tubular portion 23 of the sink flange 17 until its upper, radially inwardly extending flange 41 abuts or rests on the top surface of the cushion mount 20. The mounting ring further has an annular retaining collar portion 42 extending downwardly from the upper flange 41, which closely encircles the cushion mount 20 when coextensive therewith. In this manner, the mounting ring 19, which may be made of die cast aluminum, will preclude radial separation of the cushion mount 20 from the mounting lip 25 of sink flange 17, thereby increasing substantially the vertical load that permissably may be carried by the cushion mount.

For releasably connecting the disposer 11 to the sink flange 17, the mounting ring 19 further includes a mounting skirt 44 which extends downwardly from the retaining collar portion 42. The mounting skirt 44 is radially outwardly offset from the retaining collar portion and has an inner diameter slightly greater than the outer diameter of the hopper flange 39, so that the flange may be received in the skirt 44 and may be brought into juxtaposition with the seal surface 37 of the cushion mount 20. Because of the offset, a radially extending sealing shoulder 45 is formed inside the mount ring 20 between the retainer collar portion and mounting skirt. As shown, the sealing shoulder 45 initially rests on the sealing bead 36 of the cushion mount when the mounting ring 19 is lowered into position. With its top flange and sealing shoulder thus supported by the cushion mount, the mounting ring may be rotated relative to the sink flange to mount the disposer therebelow.

To accomplish this mounting, the mounting skirt 44 of the mounting ring 19 has two diametrically opposed slots 47 therein. The bottom, stepped surface of each slot 47 includes a horizontal lower wall portion 48, a first retaining shoulder 49, and an inclined camming ramp 50 leading upwardly from the initial retaining shoulder to a second retaining shoulder 51. The horizontal lower wall portion 48 and the first retaining shoulder 49 cooperatively define with the adjacent slot walls an opening which receives radially outwardly projecting, diametrically opposed lugs 52 on hopper flange 39.

Figure 3:
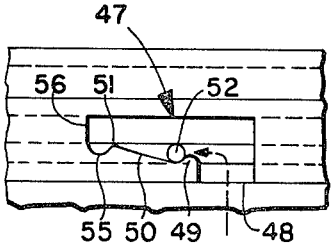
FIGS. 3 and 4 are fragmentary elevational details of the assembly of FIGS. 1 and 2 respectively showing the initial and final mounting positions of the disposer hopper flange lugs in the mounting ring camming slots.
Figure 4:
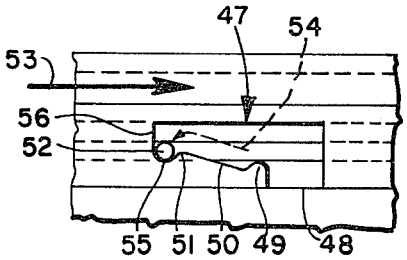

After the lugs are thus received, the disposer is elevated and the mounting ring is turned slightly to position the lugs 52 on the camming ramp in engagement with the first retaining shoulder 49, as illustrated in FIG. 3. In such position, the disposer 11 is temporarily supported by the mounting ring 19, with the top of the disposer hopper flange 39 abutting the sealing surface 37 of the cushion mount. The disposer and mounting ring are then rotated together relative to the stationary sink flange 17 until the disposer waste outlet (not shown) is in the best position for subsequent convenient coupling to the household plumbing. The mounting ring 19 is then turned counterclockwise relative to the sink flange and disposer 11 to complete the mount, as schematically indicated by arrow 53 in FIG. 4.

During this turning movement, the lugs of the disposer hopper flange are cammed upwardly along camming ramps 50 simultaneously vertically to elevate the disposer hopper flange 39 against the elastomeric sealing surface 37, thereby clampingly to compress the substantially encircled cushion mount 20. As the rotation of the mounting ring continues, the lugs 52 pass over the second retaining shoulders 51 (as indicated by arrow 54 in FIG. 4) and are captured in the locking grooves 55 formed between such shoulders and the walls 56 of slots 47. To permit easier rotation of the mount ring for this final locking movement, the mounting skirt 44 may have two outwardly projecting tightening channels 58 to receive screwdriver shanks for imparting increased torque to the mounting ring.

As thus locked, the hopper flange is urged into tight engagement with the sealing surface of the cushion mount, which is compressed to provide friction engagement with the hopper flange further to assist in retaining the same in position. With the hopper flange so clamped to the cushion mount by the mounting ring, the cushion mount provides resilient fluid tight seal between the sink flange and disposer to absorb vibration and sound otherwise passed from the disposer to the drain sleeve, thereby to provide quieter disposer operation. The assembly mount is thus completed with the disposer 11 being adapted to receive the waste and water charge via the drain opening 14, the bore 59 of the tubular portion 23 of sink flange 17 and the disposer hopper 10.

It should now be appreciated that the invention provides an uncomplicated, inexpensive, easy to install mounting assembly for a food waste disposer providing vibration absorption and quieter operation. As will be appreciated, after the plumbing is uncoupled, the disposer may also be quickly disconnected by rotating the mounting ring 19 in clockwise direction to reverse the camming procedure described, thereby to release the hopper flange lugs 52 from the mounting ring camming slots 47.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

The embodiments of the invention in which an exclusive property or privilege is claimed are defined as follows:

1. In combination with a food waste disposer having an upper hopper flange, a mounting assembly for suspending the disposer below and in communication with a drain opening in a sink, comprising a sink flange having a tubular portion received in and extending below the drain opening, means for nonrotatably securing said sink flange to the sink, an annular elastomeric cushion mount resiliently secured to said tubular portion of said sink flange beneath the sink, and mounting means rotatably carried on and substantially closely encircling said elastomeric cushion mount to clampingly urge the hopper flange to and against said cushion mount, said mounting means thereby compressing the substantially encircled cushion mount to provide a tight seal between the tubular portion of the sink flange and the hopper flange.

2. The assembly of claim 1 wherein said mounting means cammingly urges the hopper flange into compressive engagement with the underside of said cushion mount.

3. The assembly of claim 1 wherein said elastomeric cushion mount has a radially inwardly opening groove and said tubular portion has a radially outwardly extending lip at its bottom end, with said lip being received in and embraced by said groove to mount said cushion mount on said sleeve.

4. The assembly of claim 3 wherein said cushion mount is sufficiently elastically deformable to be stretched over said lip during mounting of the same, with the normal resilient contraction of the cushion mount after stretching tightly holding the cushion mount on the lip and tubular portion.

5. The assembly of claim 4 wherein said mounting means includes an annular rotatable mounting ring mounted on the tubular portion of said sink flange, said mounting ring initially being elevated on said tubular portion to permit mounting of said cushion mount on said tubular portion and then being lowered to a second supported position closely encircling said cushion mount to prevent the latter from expanding radially when subjected to axial loads by the disposer.

6. The assembly of claim 5 wherein said mounting ring at its top end has an inturned flange resting on said cushion mount for support by the latter.

7. The assembly of claim 6 wherein said mounting ring at its lower end includes cam means and said hopper flange includes cam follower means, with selective rotation of said mounting ring with cam means urging the cam follower means and hopper flange upwardly into clamped engagement with said cushion mount.

8. The assembly of claim 7 wherein said mounting ring has diametrically opposed slots having inclined upwardly facing camming surfaces and said hopper flange has radially outwardly projecting lugs received in said slots and following said cam surfaces during rotation of said mounting ring.

9. The assembly of claim 8 wherein each cam surface has first and second retaining shoulders and an inclined camming ramp therebetween, said mounting ring and hopper flange being rotatable relative to the sink flange when said lugs are received on said camming ramp and engaged by the first retaining shoulder to permit alignment between the disposer and household plumbing.

10. The assembly of claim 9 wherein the selective rotation of the mounting ring cammingly urges the lugs upwardly along the camming ramp and then over the second retaining shoulder for locking engagement thereby, this upwardly directed movement of the lugs elevates the hopper flange to compress the cushion mount and to clamp the hopper flange to the cushion mount to fix the position of the disposer.

11. In combination with a food waste disposer having a hopper flange at its upper end, a mounting assembly for suspending the disposer from a sink at the drain opening thereof, comprising:

a sink flange having an upper annular shoulder that overlaps the sink surface around the drain opening and a tubular portion extending through the drain opening beneath the sink, said tubular sleeve portion having an externally threaded upper end and an annular radially outwardly extending lip at its lower end, an internally threaded annular support ring upwardly screwed on the external threads of said tubular portion into engagement with the bottom of said sink for securing said drain sleeve to the sink, an annular elastomeric cushion mount having a radially inwardly opening groove at its inside diameter embracingly to receive said lip to secure said cushion mount to said tubular portion, and an annular mounting member encircling said tubular portion and being rotatably carried on said cushion mount, said annular mounting member including connecting means for mounting the hopper flange to the tubular portion of the sink flange to suspend the disposer therebelow.

12. The combination of claim 11 wherein said sink flange is made of plastic, and a stainless steel cap secured to the upper exposed surface of the shoulder on said sink flange to cover said shoulder and give the appearance that the entire sink flange is stainless steel.

13. The combination of claim 11 wherein the hopper flange includes lugs extending radially outwardly therefrom and the connecting means on said mounting member includes cam means for receiving and camming the lugs upwardly therealong sealingly to compress the cushion mount and to clamp the hopper flange to the cushion mount and tubular portion.

14. The combination of claim 13 wherein said cushion mount includes a body and a radially outwardly extending bead, and both the body and bead are compressed between the hopper flange and mounting ring to provide a seal therebetween.

15. The assembly of claim 1 wherein the tubular portion of said sink flange is threaded and said means for non-rotatably securing said sink flange to the sink includes an internally threaded support ring upwardly screwed on the threads of the tubular portion into engagement with the underside of the sink.

* * * * *